US012680261B2

(12) United States Patent
Fuentes Gutierrez et al.

(10) Patent No.: US 12,680,261 B2
(45) Date of Patent: Jul. 14, 2026

(54) REINFORCEMENT AND METHOD FOR OPERATING SAME

(71) Applicant: Rheinisch-Westfaelische Technische Hochschule (RWTH) Aachen Koerperschaft des Oeffentlichen Rechts, Aachen (DE)

(72) Inventors: Raul Fuentes Gutierrez, Aachen (DE); Jan Derksen, Aachen (DE)

(73) Assignee: Rheinisch-Westfaelische Technische Hochschule (RWTH) Aachen Koerperschaft des Oeffentlichen Rechts, Aachen (DE)

( * ) Notice: Subject to any disclaimer, the term of this patent is extended or adjusted under 35 U.S.C. 154(b) by 0 days.

(21) Appl. No.: 18/682,208

(22) PCT Filed: Nov. 15, 2022

(86) PCT No.: PCT/EP2022/081934
§ 371 (c)(1),
(2) Date: Feb. 8, 2024

(87) PCT Pub. No.: WO2023/110260
PCT Pub. Date: Jun. 22, 2023

(65) Prior Publication Data

US 2025/0129564 A1 Apr. 24, 2025

(30) Foreign Application Priority Data

Dec. 15, 2021 (DE) ..... 10 2021 133 157.9

(51) Int. Cl.
*E02D 31/08* (2006.01)

(52) U.S. Cl.
CPC ..... *E02D 31/08* (2013.01); *E02D 2200/14* (2013.01); *E02D 2200/1642* (2013.01); (Continued)

(58) Field of Classification Search
CPC ..... E02D 31/08; E02D 2200/14; E02D 2200/1642; E02D 2300/0084; E02D 2300/0087; E02D 2600/10; E02D 2600/40
See application file for complete search history.

(56) References Cited

U.S. PATENT DOCUMENTS 5,277,520 A * 1/1994 Travis ..... E02D 29/0241 405/302.3
7,740,042 B2 6/2010 Heerten et al.
(Continued)

FOREIGN PATENT DOCUMENTS

CN 100419185 C 9/2008
CN 205784869 U 12/2016
(Continued)

OTHER PUBLICATIONS

Japanese Office Action issued on Mar. 31, 2026 in Japanese counterpart application No. 2023-576116.

*Primary Examiner* — Kyle Armstrong
(74) *Attorney, Agent, or Firm* — Norris McLaughlin, P.A.

(57) ABSTRACT

A reinforcement for strengthening soil areas, ground surfaces, and in particular subsoils, and earthwork structures includes at least one reinforcement element, preferably a plurality of reinforcement elements which, in particular, intersect at an angle, wherein the at least one reinforcement element includes at least one actuator by way of which a property of the reinforcement element can be changed, and in particular at least temporarily changed. A structure on a subsoil, and in particular an earthwork structure includes the aforementioned reinforcement, and a method is provided for operating the aforementioned reinforcement.

10 Claims, 6 Drawing Sheets

Figure 1:
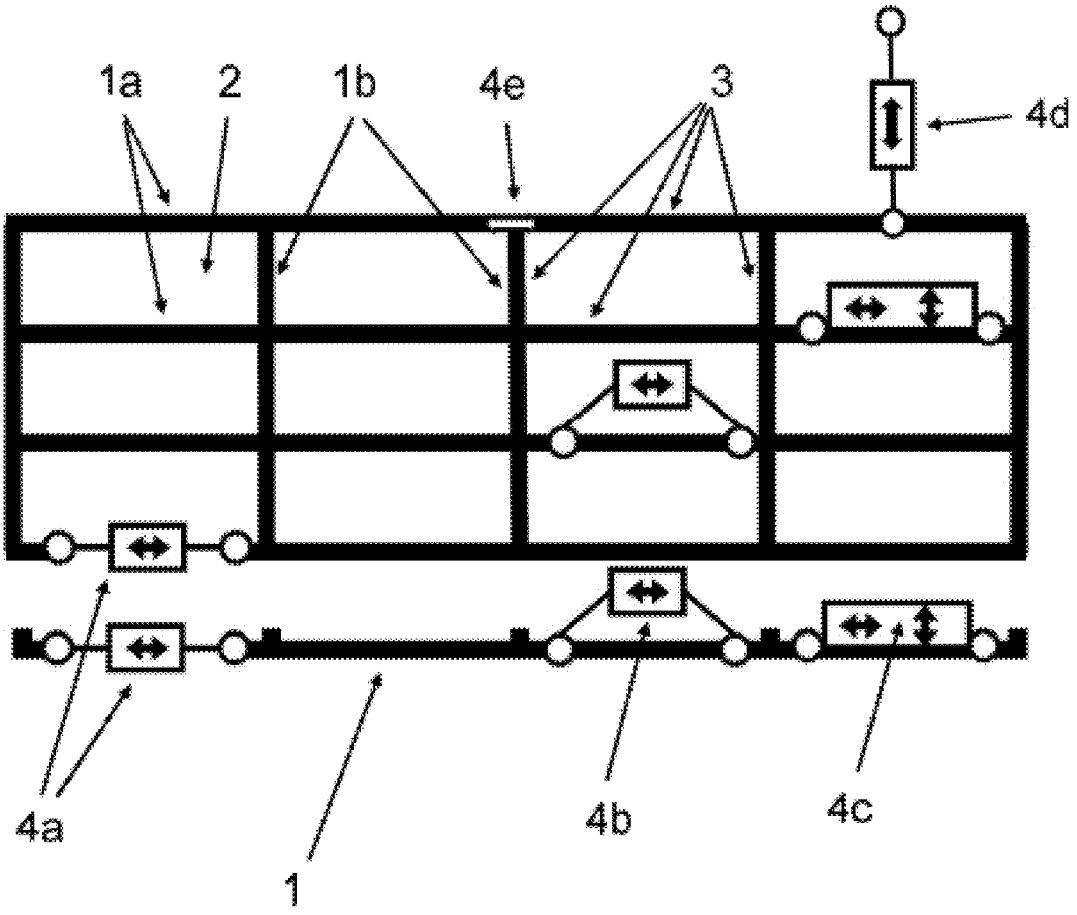

(52) U.S. Cl.
CPC ..... *E02D 2300/0084* (2013.01); *E02D 2300/0087* (2013.01); *E02D 2600/10* (2013.01); *E02D 2600/40* (2013.01)

(56) References Cited

U.S. PATENT DOCUMENTS

| | | | | |
|---|---|---|---|---|
| 9,249,552 | B2 * | 2/2016 | Tyagi | B29C 55/04 |
| 2018/0171975 | A1 | 6/2018 | Roehm | |
| 2020/0283983 | A1 | 9/2020 | Shelton et al. | |

FOREIGN PATENT DOCUMENTS

| | | | |
|---|---|---|---|
| CN | 205874869 | U | 1/2017 |
| DE | 202015000665 | U1 | 6/2015 |
| DE | 102011006190 | B4 | 9/2015 |
| DE | 102016100455 | A1 | 7/2016 |
| EP | 2505720 | A2 | 10/2012 |
| JP | S646442 | A | 1/1989 |
| JP | 2001-059224 | A | 3/2001 |
| JP | 2007-138624 | A | 6/2007 |
| JP | 2008-101445 | A | 5/2008 |
| JP | 2011-084891 | A | 4/2011 |
| JP | 2018-150679 | A | 9/2018 |
| JP | 2019-132091 | A | 8/2019 |
| KR | 10-0318987 | B1 | 12/2004 |
| KR | 10-2005-0018069 | A | 2/2005 |
| KR | 100834309 | B1 | 6/2008 |
| KR | 10-1806239 | B1 | 1/2018 |
| KR | 102122768 | B1 | 6/2020 |

* cited by examiner

REINFORCEMENT AND METHOD FOR OPERATING SAME

The invention relates to a reinforcement for strengthening soil areas, ground surfaces, and in particular subsoils and earthwork structures, comprising at least one reinforcement element, preferably a plurality of reinforcement elements which, in particular, intersect at an angle.

The invention also relates to a method for operating a reinforcement.

Reinforcements are generally known in the prior art, for example from the publication US 2020/0283983 A1. These are used to reinforce soil areas, for example, thereby improving mechanical properties in conjunction with the surrounding soil. Reinforcements are also used to improve the mechanical properties of ground surfaces, for example those underneath structures. Ground surfaces can be loosely poured or compacted, or hard ground surfaces, for example within the meaning of subsoil. Reinforcements are also used for all types of earthwork structures, for example embankments, support structures, infrastructure and traffic roadways, as foundation beds, sinkhole protection, erosion protection, vertical load-bearing elements, dams, or excavations. Reinforcements designed according to the invention are likewise considered to be included in the aforementioned reinforcements.

Frequently, such reinforcements have a lattice-shaped design, and in particular are designed as a so-called geogrid, in which lattice cells are surrounded by cell ribs, which meet at intersecting points at generally arbitrary angles. For this purpose, the reinforcement elements of an extension direction may be spaced apart from one another and intersect reinforcement elements of a different extension direction in multiple locations, thereby forming a lattice.

Such cell ribs form reinforcement elements, or parts of reinforcement elements, of the reinforcement within the meaning of the invention.

Depending on the arrangement of the reinforcement elements, uniaxial or multiaxial, in particular biaxial or triaxial reinforcements can be formed. Reinforcement elements can, for example, in each case, be designed as a strand of a material or material combination, for example fiber accumulations. Spaced-apart strands intersecting at angles can form lattices of the above-described type.

A reinforcement can also comprise only a single such strand, and in particular can form a so-called geostrip.

Such strands can be disposed, for example, so as to cross one another in reinforcements according to the invention. Reinforcement elements, however, may also be formed by the material that, in a reinforcement, surrounds openings, in particular clear, continuous openings, without being strand-shaped itself. In addition, reinforcements can be made of several individual strands or of at least one planar reinforcement element, in particular one without lattice cells or openings. The invention also relates to all of the possible embodiments of such aforementioned reinforcements, in particular to multiaxial reinforcements forming a lattice.

It is furthermore known that such reinforcements can be made of a wide variety of materials. For example, the reinforcement elements can be made of metal or plastic material, and they can likewise be made of composite materials, for example of multilayer polymer or fiber composites. The invention can also make use of any materials, in particular those mentioned above.

According to the prior art, reinforcements are passive elements that are selected and installed according to need, wherein the original requirements must be gauged very precisely. Frequently, these are deliberately overdesigned, for example to take aging processes into consideration, or to ensure that requirements that cannot be adequately assessed can be sufficiently handled by the reinforcement.

It is considered to be problematic that reinforcements of the known type can age and lose the original properties thereof, or that requirements with regard to reinforcements can change over time, for example since the characteristics of the environment change, for example as a result of deformation or load changes. Sudden changes in the situation, such as during earthquakes or heavy rains, can likewise cause static passive reinforcement to fail or initially require a certain degree of deformation to be activated. Passive static reinforcements of the conventional type cannot respond to a changing situation.

It is therefore an object of the invention to create a reinforcement of the type mentioned at the outset which allows active response to changes in the reinforcement and/or in the environment in which the reinforcement is installed. It is furthermore an object to design the properties of a reinforcement so as to be variable.

According to the invention, this object is achieved in that the at least one reinforcement element of the reinforcement comprises at least one actuator, by way of which a property of the reinforcement element can be changed, and in particular at least temporarily changed. The change in property can cause an increase or a decrease of an extent representing the property.

According to the invention, there is thus an option for changing a property of at least one reinforcement element of the reinforcement, in particular at least locally, by means of at least one actuator in a method for operating a reinforcement.

Compared to passive reinforcements of the prior art, the invention thus allows an active response to changes in the reinforcement and/or in the environment in which the reinforcement is installed. This also includes the option of being able to respond to sudden events, such as an earthquake, where responding means that a property of the at least one reinforcement element is changed by way of the at least one actuator.

It may preferably be provided that the at least one reinforcement element comprises several actuators, which are disposed in sections. In a reinforcement element, for example, sections that include an actuator, and sections without actuator, may be provided. A change in property can thus also be caused in a reinforcement element in a locally differing manner.

The invention preferably provides that several intersecting reinforcement elements form a lattice including a plurality of lattice cells, wherein at least one cell rib, and preferably several cell ribs of all of the cell ribs, which at least regionally delimit the lattice cells, comprise at least one actuator, in particular by way of which a property of the cell rib can be changed at least temporarily. A cell rib does not necessarily need to have a rectilinear extension, which is not the case, for example, when a lattice cell surrounds a non-angular opening. Lattice cells can thus form openings having any shape, for example, round and not round, in particular polygonal, and preferably triangular, quadrangular, pentagonal or hexagonal.

Within the meaning of the invention, a cell rib shall be understood to mean an arrangement of material, regardless of shape, which at least regionally delimits, and in particular surrounds, the opening of a lattice cell. The openings formed by lattice cells are preferably hollow so as to allow ground material to enter the openings, and in particular pass through.

In the embodiment of a lattice, a reinforcement element may be understood to mean such an element that at least partially extends through the reinforcement and delimits several different lattice cells. Cell ribs can thus be sub-regions of reinforcement elements.

According to the invention, actuators can be disposed in the reinforcement in different manners. It may be provided, for example, that an actuator is disposed in at least one reinforcement element, and in particular in a cell rib. In this case, the actuator can preferably be at least partially, and preferably completely, surrounded by material of the reinforcement element/of the cell rib. For example, the actuator can be centrally integrated into the cross-section of a reinforcement element/a cell rib.

It is also an option for an actuator to be formed, instead, of at least a sub-section of the at least one reinforcement element, and in particular instead of a cell rib. Such an actuator thus interrupts a reinforcement element or a cell rib. The actuator accordingly connects neighboring separate regions of the same reinforcement element.

It may also be provided that an actuator is attached outside the at least one reinforcement element, and in particular of a cell rib. An actuator can preferably include two attachment points, which are attached to and spaced apart from the reinforcement element. An actuator can preferably be disposed at a distance with respect to the reinforcement element. In this case, the actuator and the reinforcement element can be contact-free, with the exception of the attachment points. However, an actuator can also be disposed so as to be in contact with the reinforcement element, in particular between the attachment points thereof to the reinforcement element. Preferably, it may be provided that an actuator is oriented with a direction of action parallel to the extension direction of the reinforcement element, and in particular of the cell rib.

The invention can also provide that an actuator is disposed between two reinforcement elements, preferably between two neighboring reinforcement elements, in particular cell ribs. In this way, properties of the reinforcement can be changed particularly well in directions that deviate from an extension direction of a reinforcement element.

An actuator can also be attached on one side to the reinforcement element and, on another side, to the environment in which the reinforcement element is embedded, in particular to an earthwork structure. The actuator can thus act between the reinforcement element and the environment.

The invention can preferably provide that a plurality of different possible properties of the at least one reinforcement element can be changed by way of the at least one actuator, in particular at least locally at the site of the actuator.

For example, it may be provided that the outer dimension of the reinforcement element can be changed in at least one direction, and preferably simultaneously in several directions. The dimension that can be changed can, for example, be a length or a thickness or, generally speaking, the cross-section of a sub-section of the reinforcement element.

Likewise, the shape, preferably the extension direction, and in particular a curvature, can be changed by way of an actuator. For example, a reinforcement element can be curved to a greater extent or a lesser extent, at least regionally, by way of the actuator.

Using an actuator, it is also possible, for example, to change the position of the reinforcement element, in particular at least locally, relative to the environment. For example, a spacing between the reinforcement element and the surrounding soil area can be generated by way of the actuator. In particular, an artificial gap formation in the soil area can be brought about, or soil pressure can be generated. Ground vibrations can thus, for example, be at least temporarily decoupled from foundations in the environment of which a reinforcement according to the invention is used. This can be advantageous, for example, in the event of suddenly occurring earthquakes.

Using an actuator, for example, it is also possible to change the rigidity and resistance of the reinforcement element and/or of the environment to expansion and/or compression, or to change strains, stresses or forces generated therein and/or thereon and/or to change the vibration damping.

Suitable actuators can be designed in a variety of ways. For example, the invention can preferably provide that the at least one actuator is formed by a cylinder-piston assembly. This may be pneumatically or hydraulically operated, for example. An actuator can also be designed as a linear motor, in particular of an electrical kind. An actuator can also be designed as a piezoelectric element or as a dielectric elastomer or as systems based on magnetism.

In one possible embodiment, an actuator can also be an element that is inflatable and/or deflatable by way of a fluid, in particular a gas or a liquid. This element can preferably be integrated into a reinforcement element, or the reinforcement element itself forms the inflatable and/or deflatable element. For this purpose, the reinforcement element can be designed to be hollow.

The at least one actuator can be supplied with energy and/or control signals, for example, by lines that run outside the at least one reinforcement element, or in the at least one reinforcement element, or in a contactless manner. In particular in the case of a hollow design of at least one fluid-conducting reinforcement element, the reinforcement element itself can also form the feed line. A reinforcement element can also form at least one pole of an energy supply unit.

Generally speaking, the invention can provide that the reinforcement according to the invention comprises a control unit by way of which an actuator can be activated, in particular so as to carry out an actuator-specific action. The activation can encompass the transmission of electrical energy or electrical signals, or the transfer of fluids, such as gas or liquid. Each actuator is preferably connected to the control unit. Such a connection can be present separately for each actuator to the control unit, or a shared connection, in particular in the manner of a bus connection, can be present for several actuators, via which several actuators can preferably be individually addressed. It is also possible for a dedicated control unit to be assigned to each actuator.

The reinforcement can preferably comprise at least one control unit and at least one sensor for measuring and detecting a state of the at least one reinforcement element and/or the environment thereof, wherein the control unit is configured to activate the at least one actuator as a function of the detected state. A sensor can be provided, for example, for measuring vibrations, forces, strains, stresses, soil moisture, displacements, temperature, and the like. A sensor can be disposed in the vicinity of an actuator, at an actuator, or spaced apart therefrom.

A control unit can be an integral technical part of a reinforcement, but be installed, for example, outside the soil area in which the at least one reinforcement element is installed. The control unit can also be integrated into the reinforcement, in particular in a reinforcement element or one of several actuators.

For example, the at least one sensor can be used to measure, as the state, the vibration of the environment, for example during an earthquake, and, as a function thereof, a property of the at least one reinforcement element can be changed, preferably locally, in particular in at least one cell rib. It is also possible, for example, to measure a moisture penetration as the state, or any other state variable of interest.

The invention can provide activating at least one actuator, preferably several actuators simultaneously, of the reinforcement as a function of the readings of the at least one sensor. However, it may also be provided that a dedicated sensor, and in particular also a dedicated control unit, is assigned to each actuator. In this way, there is an option for carrying out a property change locally for each actuator at the site thereof, independently of other actuators.

The invention allows the option of changing the properties of a reinforcement using activated actuators. Such changes can generally be manually triggered. In contrast, it is preferably provided within the framework of an automatic measurement of sensor readings to automatically activate the at least one actuator.

For example, the control unit may be integrated into a control loop so as to control a monitored state variable of the surrounding soil area and/or of the reinforcement or of at least one reinforcement element by changing at least one property to a target value by way of actuator activation.

The invention can provide the use of a reinforcement provided with actuators in different arrangements. For example, at least two such reinforcements can be disposed parallel, spaced apart on top of one another in the soil area, for example in a respective horizontal orientation. Different reinforcements can also use different actuators. Reinforcements of this type can also be used at an angle with respect to the horizontal plane, for example as erosion protection on embankments.

Exemplary embodiments of the invention will be described hereafter based on the figures.

FIG. 1 shows a reinforcement in a biaxial design, in which several reinforcement elements 1*a* are disposed spaced apart from one another, extending in a first direction, and several reinforcement elements 1*b* are disposed spaced apart from one another, extending in a second direction. The two directions are preferably perpendicular to one another. The upper area shows a top view, and the lower area of FIG. 1 shows a side view.

The reinforcement elements 1*a* and 1*b* each form a strand made of a selected material, for example metal or plastic or composite material, or in the form of a fiber aggregate.

The reinforcement elements intersect several times, thereby forming a lattice including lattice cells 2, wherein each lattice cell 2 is bounded by cell ribs 3. Each cell rib 3 is a sub-region of a reinforcement element 1*a* or 1*b*.

As an alternative, which is not shown, a reinforcement may also only be formed of a reinforcement element 1 and accordingly have a uniaxial design or be designed as a planar element.

Such reinforcements can be used in the ground/in the soil, for example underneath foundations or in the environment thereof or for the general fortification of soil areas, for example to increase the load-bearing capacity or reduce deformations, for example in the embankment area. Such reinforcements can also be used in ground surfaces underneath other structures, for example in foundations. In the case of lattice-like reinforcements, the material of the subsoil, in particular soil, can also enter or pass through the lattice cells.

The invention is thus designed, here, such that at least one reinforcement element, in the representation here several reinforcement elements 1*a*, and in particular the sections of these reinforcement elements 1*a* which form the cell ribs 3, comprise at least one actuator 4. The reinforcement elements 1*b* can also comprise at least one actuator, however, this is not shown here.

A property of the reinforcement element 1*a* or cell rib 3 comprising such an actuator can be changed by way of this actuator 4. The change of the property can preferably be carried out in a direction-based manner. So as to be able to achieve this, each of the actuators 4 can have at least one or more distinct directions of action, which in the representation here are shown by the arrows in the actuators 4.

By way of example, several types of actuators 4 can be distinguished here. The actuators 4*a* are inserted between two separate spaced-apart regions of the same reinforcement element 1*a* or cell rib 3, connecting these two regions by bridging these. The actuators 4*a* thus replace a region of the reinforcement element 1*a* at the site of the use thereof.

The actuators 4*b* are disposed outside of a reinforcement element 1*a* or cell rib 3, here spaced apart therefrom, so that a contact between the actuator 4*b* and the reinforcement element 1*a* or cell rib 3 only exists at the spaced-apart attachment points. In the process, the actuators 4*b* span a region of a reinforcement element 1/1*a* or cell rib 3.

The actuators 4*c* are likewise disposed outside of the reinforcement element 1/1*a* or cell rib 3, but in contact therewith, for example, integrally formed thereon or only regionally integrated. In this exemplary embodiment, these actuators 4*c* have two different directions of action.

The actuator 4*d* symbolizes an actuator type that acts between the reinforcement element 1*a* and the environment. The actuator 4*a* is attached on one side to the reinforcement element 1*a* and, on the other side thereof, in the environment of the reinforcement element, for example an earthwork structure.

Actuators completely integrated into a reinforcement element 1*a* or cell rib 3 are represented by the actuator 4*e*.

The use of the actuators 4 described here is not limited to the reinforcement according to the specific representation in FIG. 1, but these types of actuators 4 can generally be provided in/at a reinforcement element in any reinforcement that is possible according to the invention.

It is apparent that a property of the reinforcement element 1*a*/cell rib 3 can be changed by way of the actuators 4 at least locally, at the site of the actuator 4, and in particular also in an environment around the actuator 4, for example by exerting a force by way of the actuator between the attachment points thereof to the reinforcement element 1*a* or cell rib 3.

Figure 2:
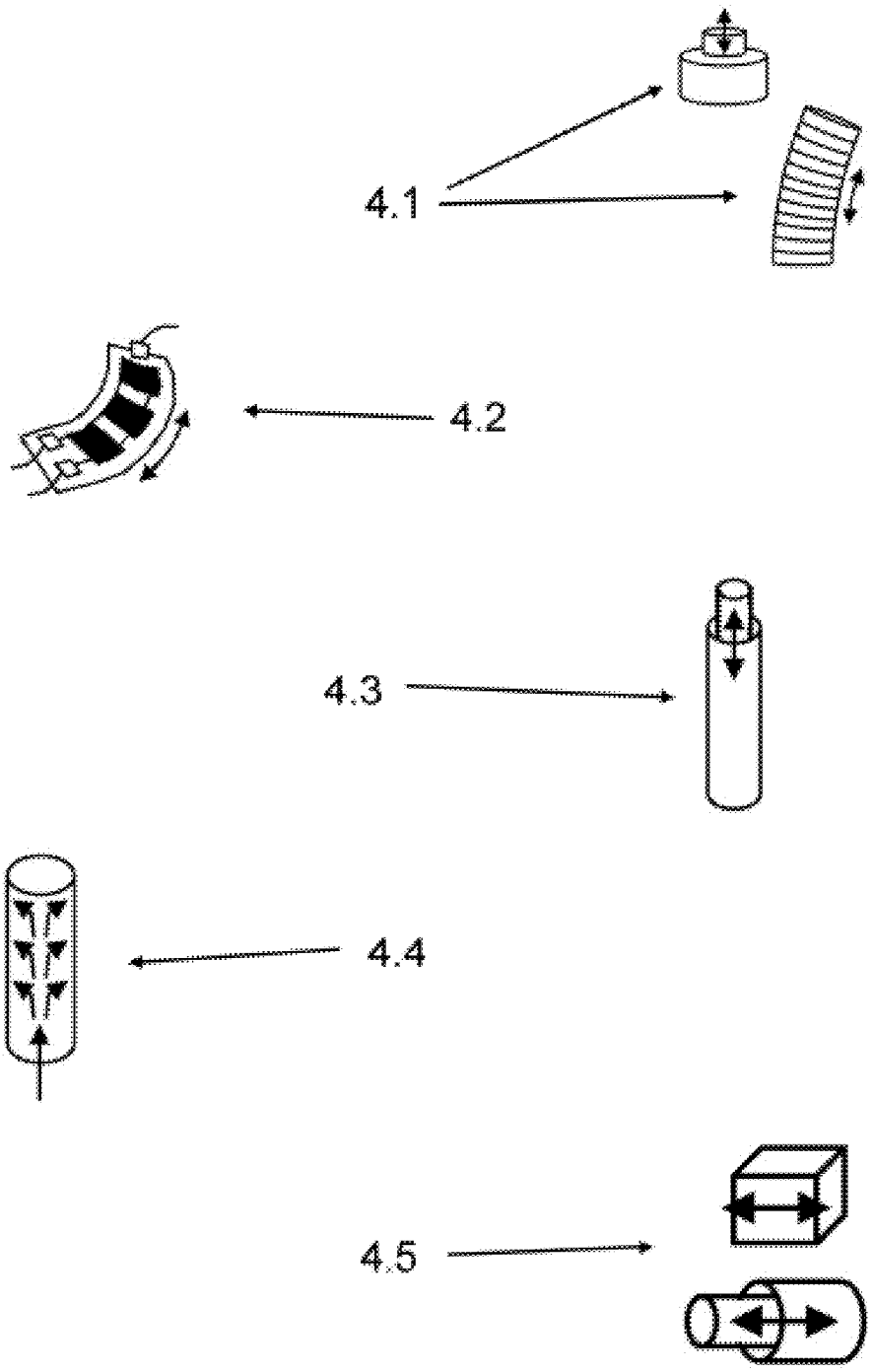

FIG. 2 schematically illustrates examples of possible actuators 4. For example, piezoelectric actuators 4.1 can be used. With these, linear movements as well as curvatures can be generated. Forces in the range of presently up to 100 kN, for example, are possible using such actuators. Dielectric elastomers 4.2 can also form actuators, by way of which curvatures can preferably be achieved. Linear actuators 4.3 can preferably be used, for example, having an electrical, a magnetic, a pneumatic or a hydraulic design, for example for exerting a force in the range of presently up to 1.5 kN. The actuators 4.4 are elements that can be inflated and/or deflated by fluids, for example gases or liquids, which thereby change the outer shape and/or dimensions thereof. The actuators 4.5 are magnetically and/or electromagnetically acting actuators.

All actuators 4 shown here, as well as types of actuators that are not shown, are suitable for bringing about a property change in a reinforcement element upon actuation, when such a reinforcement element comprises an actuator. A property of just the reinforcement element alone may be changed, or a property may be changed in terms of cooperation between the reinforcement element and the environment.

Figure 3:
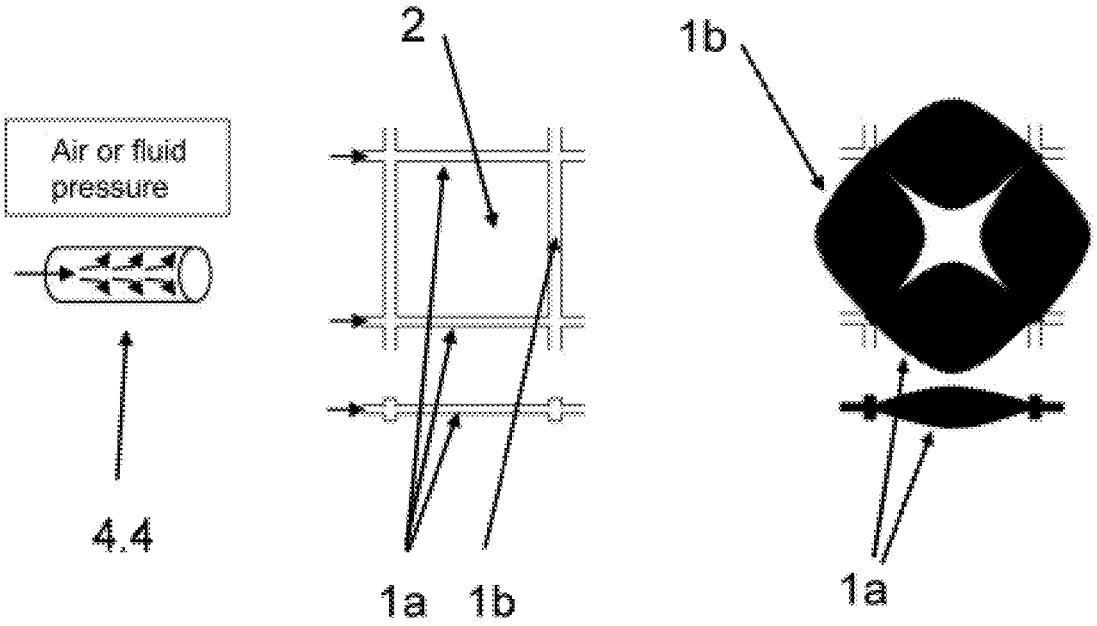

FIG. 3 shows an example of the use of an actuator 4.4 that can be inflated and/or deflated by a fluid. This actuator preferably acts in a substantially omnidirectional manner. The actuator 4.4 can be formed by a hose, which also forms the reinforcement element 1*a* and/or 1*b*. The actuator, however, can additionally also be inserted into a reinforcement element. Fluid supply can preferably also be carried out through a respective reinforcement element 1*a*, 1*b*.

In the center, FIG. 3 shows a state in which the reinforcement elements 1*a*, 1*b* are not inflated. In contrast, on the right, FIG. 3 shows an inflated state of the reinforcement elements 1*a*, 1*b*. It is clearly apparent that the reinforcement elements 1*a*, 1*b* have a significantly larger cross-section and thereby decreasing the size of the lattice cell 2. There is thus an option for changing a dimensional property of the reinforcement. In this way, it is also possible, for example, to exert a force on the surrounding soil.

Figure 4:
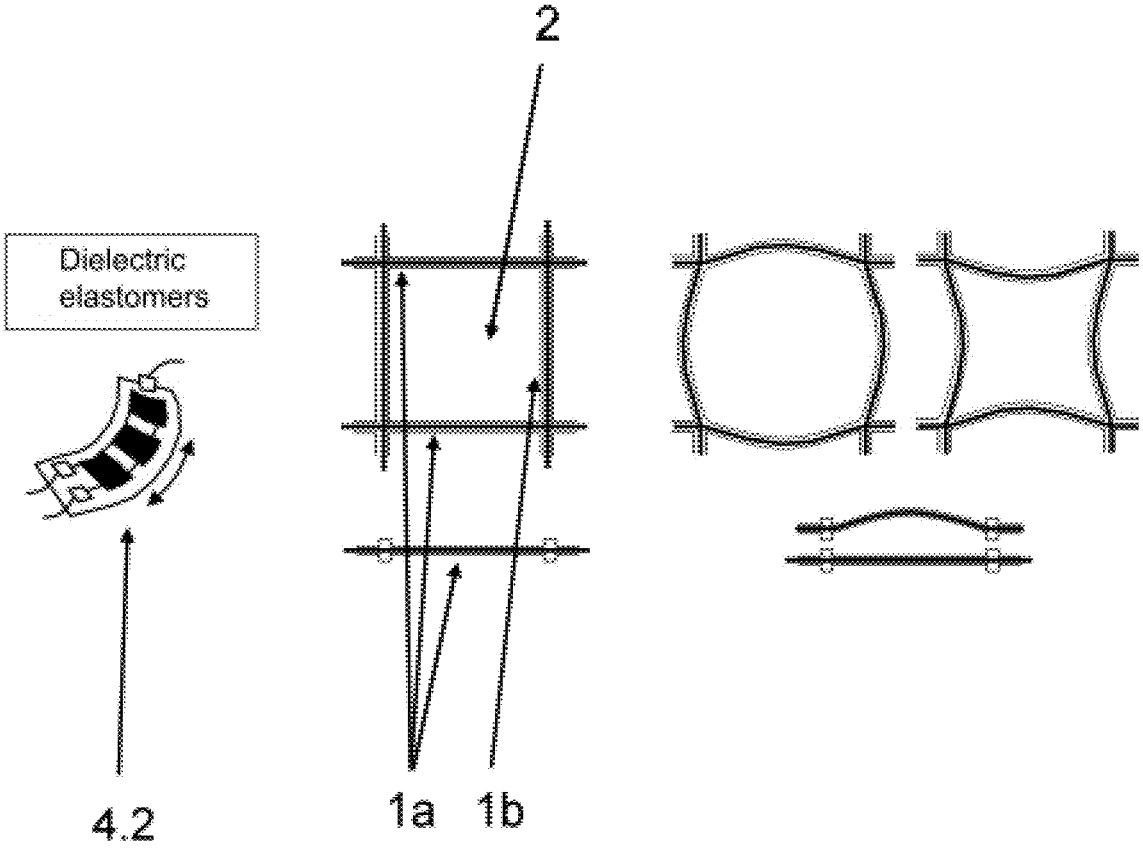

FIG. 4 shows a possible use of an actuator by way of which a shape change, essentially by curving of the reinforcement elements 1*a*, 1*b*, can be carried out in a lattice-like reinforcement, for example by way of dielectric elastomers. An actuator 4.2 comprising dielectric elastomers can preferably be integrated into a reinforcement element 1*a*, 1*b*, for example a respective cell rib. It is advantageous here that different curvature directions of the lattice ribs can be achieved by different polarities of the operating voltage. In this way, a shape property of the reinforcement elements 1*a*, 1*b* can also be changed here. For example, specifically, the clear cross-section of the lattice cell 2 can be increased, as well as decreased, or ground pressure, or a ground opening, in the environment can be achieved.

Figure 5:
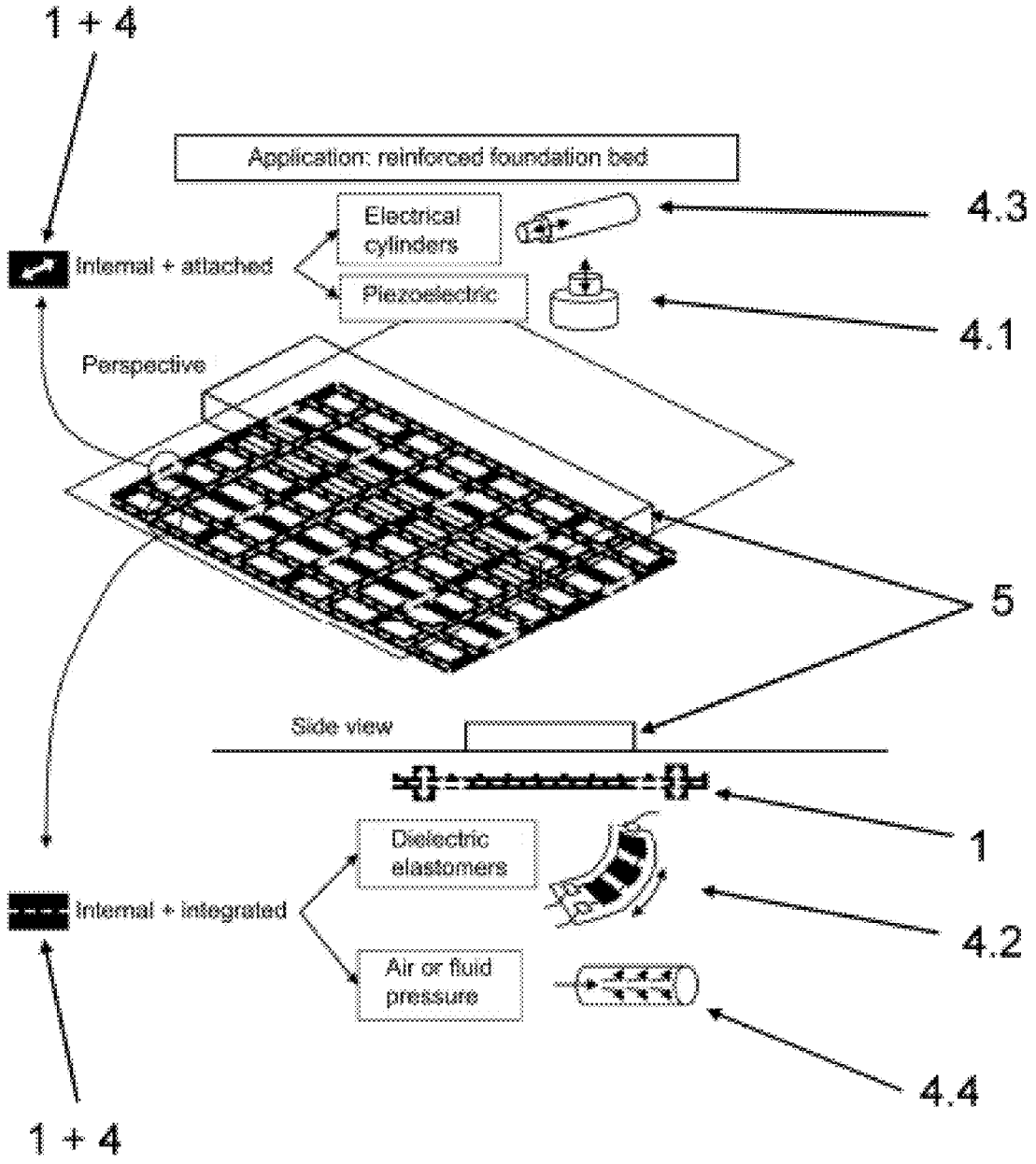

FIG. 5 shows a specific exemplary application for reinforcing the soil area underneath a foundation 5. A reinforcement, in the form of a lattice, including intersecting reinforcement elements 1 is apparent here underneath the foundation 5 in the soil area. This example shows the use of differing actuators. The reinforcement elements 1 are depicted in the figure with a black line, and the actuator type is shown by white symbols disposed therein. A double arrow represents actuators attached to the reinforcement element 1, for example piezo actuators 4.1 or linear actuators 4.3. A white dotted line shows, for example, actuators integrated into a reinforcement element 1, for example dielectric elastomers 4.2 or inflatable/deflatable actuators 4.4. In this way, changes can be made to a property, or in particular to different properties, of the reinforcement elements in different manners. For example, the ground underneath a foundation 5 of a building can be stabilized during an earthquake.

Figure 6:
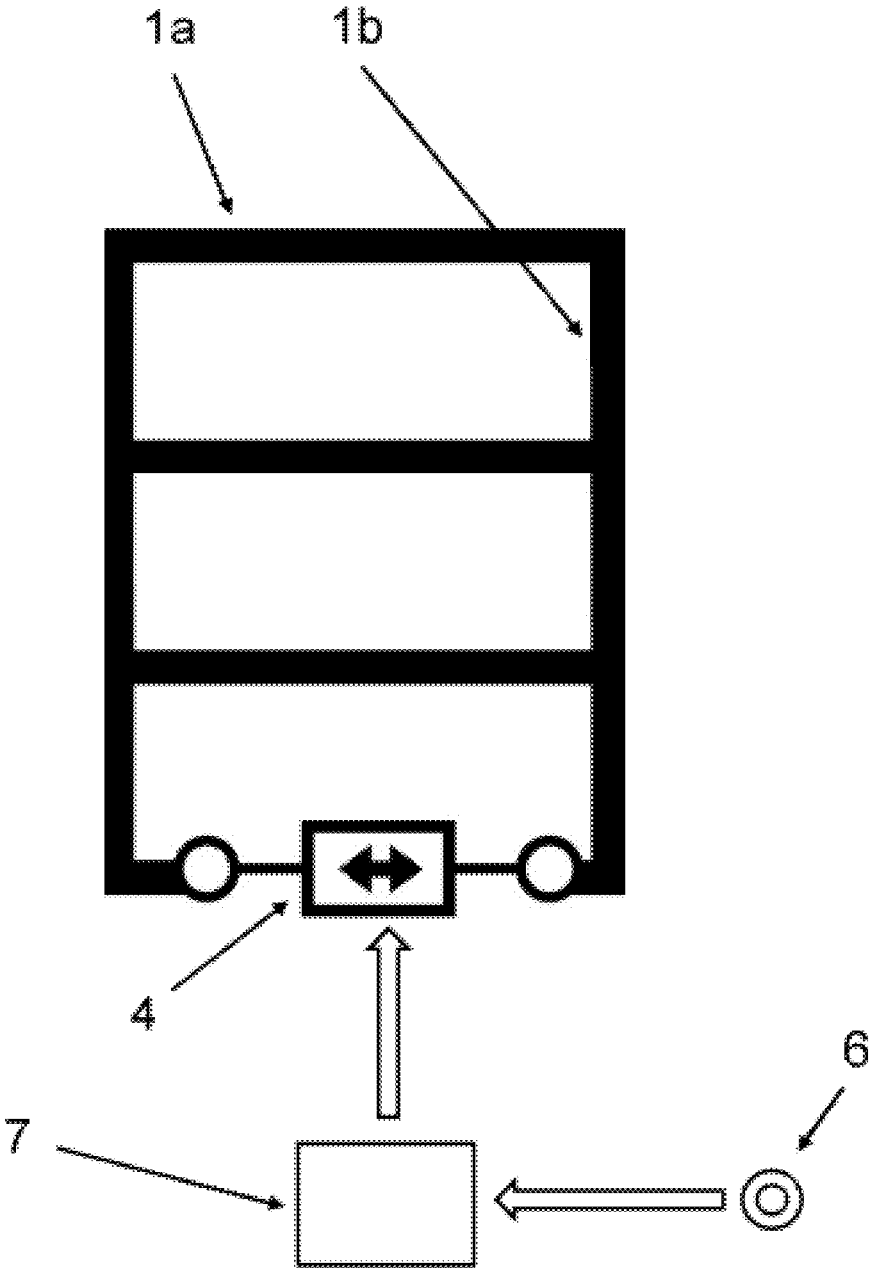

FIG. 6 shows a method according to the invention being carried out, using a lattice-shaped reinforcement including intersecting reinforcement elements 1*a* and 1*b*, which form lattice cells. The method shown is not limited to the illustrated type of reinforcement, but may generally be carried out with any reinforcement according to the invention. For simplification, only few reinforcement elements 1*a*, 1*b* and only one actuator 4 are shown here. What is essential for the method is the use of a sensor 6, by way of which state variables from the environment of the reinforcement can be measured, for example a measure for vibrations, for example during an earthquake. The sensor 6 can also be disposed directly at a reinforcement 1*a*, 1*b*.

The sensor readings are transmitted to a control unit 7 and detected thereby, and possibly evaluated. It is preferably provided that the actuator 4 is activated by the control unit 7 as a function of the sensor readings of the sensor 6 so as to bring about a change of a property, at least in the reinforcement elements comprising this actuator 4. If feedback exists between the changed property and the sensor reading, and in particular the sensor measures a property of the reinforcement element, a control loop may also be implemented, for example so as to control a desired property of the reinforcement element to a target value.

The invention claimed is:

1. A reinforcement for strengthening soil areas, ground surfaces, subsoils, and earthwork structures, comprising at least one reinforcement element or a plurality of reinforcement elements which intersect at an angle, wherein at least one of the reinforcement elements comprises or is operatively connected to at least one actuator configured to at least temporarily change a property of the reinforcement element, and the reinforcement further comprising at least one control unit and at least one sensor configured to measure and detect a state of the at least one reinforcement element or the at least one cell rib and/or of the environment thereof, the control unit being configured to activate the at least one actuator as a function of the detected state.

2. The reinforcement according to claim 1, wherein the at least one reinforcement element comprises a plurality of actuators which are disposed in sections of the at least one reinforcement element.

3. The reinforcement according to claim 1, wherein a plurality of the intersecting reinforcement elements comprise a plurality of cell ribs which form a lattice including a plurality of lattice cells delimited by the plurality of cell ribs, and the at least one actuator is configured to change at least temporarily at least one property of at least one of the cell ribs.

4. The reinforcement according to claim 1, wherein the at least one reinforcement element comprises a laid scrim or woven fabric.

5. The reinforcement according to any one of claims 1 to 4, wherein the at least one actuator a. is disposed in the at least one reinforcement element or in the at least one cell rib; or b. is formed of at least a sub-section of the at least one reinforcement element or of the at least one cell rib or neighboring separate regions of a same reinforcement element or cell rib are connected by the at least one actuator; or c. is attached to the at least one reinforcement element or to one of the cell ribs outside of the reinforcement element or cell rib spaced apart therefrom or in contact therewith, with a direction of action parallel to a direction of extension of the reinforcement element or of the cell rib; or d. is disposed between neighboring reinforcement elements or cell ribs; or e. is disposed between at least one of the reinforcement elements and an earthwork structure, in which the reinforcement element is embedded.

6. The reinforcement according to any one of claims 1 to 4, wherein the at least one actuator is configured to change at least temporarily the at least one property of the at least one reinforcement element or the at least one cell rib at least locally at the site of the at least one actuator and the at least one property comprises at least one of the following:

a. an outer dimension in at least one direction, and/or
b. a shape and roughness or an extension direction or a curvature, and/or
c. a position relative to the environment, and/or
d. a rigidity to expansion and compression, and/or
e. a strength, and/or
f. stresses or forces generated therein, and/or
g. vibration damping thereof.

7. The reinforcement according to claim 1, wherein the at least one actuator is formed by:

a. a cylinder-piston assembly configured to be operated pneumatically or hydraulically; or
b. a linear motor; or
c. a piezoelectric element; or
d. a magnetic element or an electromagnetic element; or
e. a dielectric elastomer; or
f. an element configured to be inflatable and/or deflatable by way of a gas or a liquid.

8. The reinforcement according to claim 1, wherein a respective one of the sensors and a respective one of the control units is assigned to each of the actuators.

9. A structure on a subsoil or an earthwork structure, wherein the structure or the subsoil thereof includes a reinforcement according to claim 1.

10. A method for operating a reinforcement according to claim 1 or 3, wherein the at least one sensor measures and detects a state of the at least one reinforcement element or the at least one cell rib and/or the environment thereof, and the control unit activates the at least one actuator as a function of the detected state so that the at least one actuator at least temporarily changes at least one property of at least one of the reinforcement elements or cell ribs at least locally.

* * * * *